US007669384B2

(12) United States Patent
Kaida et al.

(10) Patent No.: US 7,669,384 B2
(45) Date of Patent: Mar. 2, 2010

(54) EXTRUDED HOLLOW ALUMINUM ALLOY PANEL AND METHOD FOR PRODUCING THE SAME

(75) Inventors: Kazuhiro Kaida, Shimonoseki (JP); Akira Sakae, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 212 days.

(21) Appl. No.: 11/426,688

(22) Filed: Jun. 27, 2006

(65) Prior Publication Data

US 2007/0033899 A1 Feb. 15, 2007

(30) Foreign Application Priority Data

Jul. 20, 2005 (JP) ..... 2005-210081

(51) Int. Cl.

| | |
|---|---|
| ***E04C 2/32*** | (2006.01) |
| ***B60J 5/06*** | (2006.01) |
| ***B23K 20/12*** | (2006.01) |
| ***B21D 53/88*** | (2006.01) |

(52) U.S. Cl. ..... 52/790.1; 52/783.11; 52/793.1; 296/155; 428/598; 29/897.2

(58) Field of Classification Search ..... 52/783.11, 52/783.12, 783.17, 782.11, 793.1, 790.1; 296/155, 191, 184.1, 193.07; 428/654, 598, 428/593; 29/897.2, 897.3, 897.32
See application file for complete search history.

(56) References Cited

U.S. PATENT DOCUMENTS

| | | | | |
|---|---|---|---|---|
| 5,050,362 | A * | 9/1991 | Tal et al. | 52/588.1 |
| 5,098,156 | A | 3/1992 | Vogel | |
| 5,664,826 | A * | 9/1997 | Wilkens | 296/186.1 |
| 5,893,251 | A * | 4/1999 | Lund-Hansen | 52/588.1 |
| 6,219,983 | B1 * | 4/2001 | Grakjaar et al. | 52/403.1 |
| 6,224,142 | B1 * | 5/2001 | McCormack | 296/191 |
| 6,513,862 | B2 * | 2/2003 | Dodson et al. | 296/155 |
| 6,840,426 | B2 * | 1/2005 | Aota et al. | 228/112.1 |
| 7,032,804 | B2 * | 4/2006 | Aota et al. | 228/112.1 |
| 7,047,697 | B1 * | 5/2006 | Heath | 52/177 |
| 7,056,594 | B2 * | 6/2006 | Aota et al. | 428/593 |
| 7,073,701 | B2 * | 7/2006 | Aota et al. | 228/112.1 |
| 2002/0060472 | A1 * | 5/2002 | Dodson et al. | 296/155 |

(Continued)

FOREIGN PATENT DOCUMENTS

| | | |
|---|---|---|
| DE | 43 35 501 A1 | 4/1995 |

(Continued)

OTHER PUBLICATIONS

Machine translation of above DE Patent.*

(Continued)

*Primary Examiner*—Richard E Chilcot, Jr.
*Assistant Examiner*—Ryan D Kwiecinski
(74) *Attorney, Agent, or Firm*—Oblon, Spivak, McClelland, Maier & Neustadt, L.L.P.

(57) ABSTRACT

An extruded hollow aluminum alloy panel includes a panel body and a guide rail that are integrally formed by extrusion so as to extend in an extrusion direction. The panel body has a plurality of closed spaces defined between plates by ribs in a cross section perpendicular to the extrusion direction. The guide rail has an open space in the cross section.

5 Claims, 6 Drawing Sheets

U.S. PATENT DOCUMENTS

| | | | | |
|---|---|---|---|---|
| 2003/0042293 | A1 * | 3/2003 | Ezumi et al. | 228/112.1 |
| 2004/0069835 | A1 * | 4/2004 | Aota et al. | 228/112.1 |
| 2006/0254188 | A1 * | 11/2006 | Aota et al. | 52/643 |

FOREIGN PATENT DOCUMENTS

| | | | |
|---|---|---|---|
| DE | 197 09 315 | | 3/1997 |
| DE | EP 1118498 | A2 * | 7/2001 |
| EP | 0 508 434 | A1 | 4/1992 |
| EP | 1 118 498 | A2 | 12/2000 |
| EP | 1118498 | A2 * | 7/2001 |
| FR | 2838704 | | 10/2003 |
| JP | 04-157014 | | 5/1992 |
| JP | 2001-62511 | | 3/2001 |
| JP | 2001-71025 | | 3/2001 |
| JP | 2001-79610 | | 3/2001 |
| JP | 2002-145116 | | 5/2002 |
| JP | 2002-282931 | | 10/2002 |
| JP | 2003-120116 | | 4/2003 |
| JP | 2004-168106 | | 6/2004 |
| JP | 2005-7479 | | 1/2005 |
| JP | 2005-152962 | | 6/2005 |
| WO | WO 8605754 | A1 * | 10/1986 |

OTHER PUBLICATIONS

U.S. Appl. No. 11/532,797, filed Sep. 18, 2006, Sakae.

* cited by examiner

EXTRUDED HOLLOW ALUMINUM ALLOY PANEL AND METHOD FOR PRODUCING THE SAME

BACKGROUND OF THE INVENTION

1. Field of the Invention

The present invention relates to extruded hollow aluminum alloy panels and methods for producing the hollow panels.

2. Description of the Related Art

Guide rails for guiding sliding doors, for example, are attached to panels such as floor panels for automobiles. According to Japanese Unexamined Patent Application Publication No. 2004-168106, for example, a guide rail is fixed to a body of a floor panel by welding. According to Japanese Unexamined Patent Application Publication No. 2002-145116, a guide rail is fastened to an outer quarter panel. According to Japanese Unexamined Patent Application Publication No. 2003-120116, a guide rail is fastened to an inner door panel at a plurality of positions using bolts and nuts. Such guide rails are usually formed by bending a steel plate so that they have an open space in cross section.

SUMMARY OF THE INVENTION

Guide rails of the known art are produced by bending a steel plate and are fixed to panels by fastening or welding. Unfortunately, such guide rails cannot avoid some variations in the positions where they are to be attached and also require complicated production processes.

Accordingly, an object of the present invention in light of the above problems is to provide an extruded hollow aluminum alloy panel that has an accurately defined open segment and can be produced by a simpler process.

To achieve the above object, the present invention provides an extruded hollow aluminum alloy panel including a plurality of plates and a plurality of ribs joining the plates. This hollow panel includes an open segment and a closed segment that are integrally formed by extrusion so as to extend in an extrusion direction. The closed segment has a plurality of closed spaces defined between the plates by the ribs in a cross section perpendicular to the extrusion direction. The open segment has an open space in the cross section.

According to the present invention, the open segment and the closed segment are integrally formed by extrusion. The position where the open segment is formed therefore depends on the size and shape of a die of the extruder used. This ensures stable positional and dimensional accuracy of the open segment. In addition, the hollow panel can be produced by a simpler process than panels of the known art which have an open segment attached later by, for example, welding.

In a possible example of the extruded hollow aluminum alloy panel, the plurality of plates includes two plates, and the open segment includes the rib disposed at an end of the hollow panel in the width direction of the cross section, protruding portions protruding from the two plates to the outside of the rib in the width direction, and extended portions extended from the outer ends of the protruding portions to the inside of the plates. The extended portions define an opening extending in the extrusion direction to form the open space.

In another possible example of the extruded hollow aluminum alloy panel, the plurality of plates includes two plates, and the open segment is constituted by the two plates and two adjacent ribs of the ribs. One of the two plates has an opening extending between the two adjacent ribs in the extrusion direction to form the open space.

The open segment may be formed of an aluminum alloy having a higher strength than the aluminum alloy for the closed segment.

In addition, the extruded hollow aluminum alloy panel may be configured as any one of a floor panel, a door panel, and a roof panel for automobiles, and the open segment may be configured as a guide rail.

If the guide rail has a higher strength than other portions, the required strength of the guide rail can be ensured while inhibiting the increase in panel weight.

The present invention further provides a method for producing the extruded hollow aluminum alloy panel. This method includes the step of integrally forming the open segment and the closed segment by extruding the materials therefor together.

According to this method, the open segment and the closed segment can be integrally formed in one extrusion operation without the need for the step of, for example, welding the two segments after the extruding step. The hollow panel can thus be produced by a simpler process.

The present invention further provides another method for producing the extruded hollow aluminum alloy panel. In this method, the open segment can be formed of an aluminum alloy having a higher strength than the aluminum alloy for the closed segment. This method includes the steps of preparing a composite material billet with the aluminum alloy for the open segment and the aluminum alloy for the closed segment and extruding the composite material billet to form the extruded hollow aluminum alloy panel.

According to this method, the open segment and the closed segment can be formed using different aluminum alloys in one extrusion operation. The hollow panel can thus be produced by a simpler process.

The present invention, as described above, can provide a simpler process for producing an extruded hollow aluminum alloy panel having an accurately defined open segment.

DESCRIPTION OF THE PREFERRED EMBODIMENTS

Preferred embodiments of the present invention will now be described in detail with reference to the drawings.

First Embodiment

Figure 1:
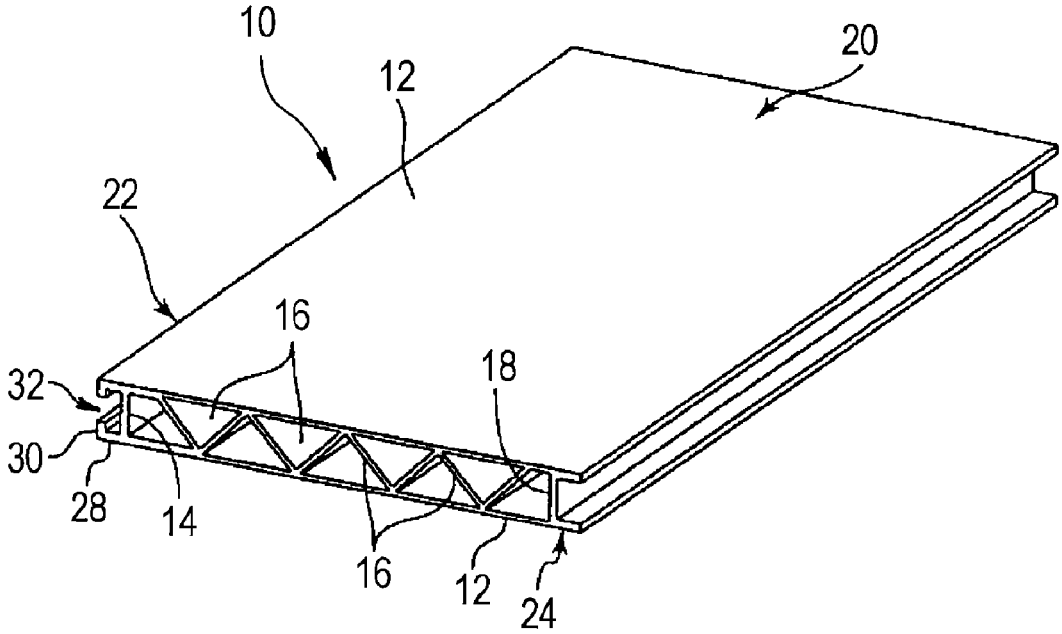
FIG. 1 is an overall perspective view of a hollow panel according to a first embodiment of the present invention.
Figure 2:
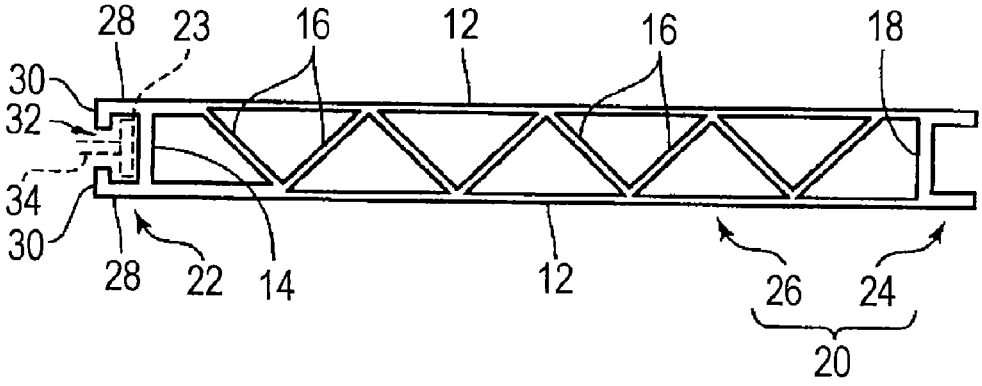
FIG. 2 is a side view of the hollow panel in an extrusion direction.

FIGS. 1 and 2 illustrate an extruded hollow aluminum alloy panel (hereinafter simply referred to as a hollow panel) according to a first embodiment of the present invention. The hollow panel according to this embodiment is configured as a floor panel for automobiles. The hollow panel is a one-piece panel formed by extruding an aluminum alloy. FIG. 2 is a side view of the hollow panel in an extrusion direction. The method of extrusion is described later.

In FIGS. 1 and 2, a hollow panel 10 includes a pair of parallel flat plates 12 separated in the thickness direction thereof and joined by many ribs disposed therebetween. The ribs include a first rib 14, second ribs 16, and a third rib 18, as will be described later in detail.

The hollow panel 10 includes a panel body 20, as an example of a closed segment, and a guide rail 22, as an example of an open segment. In this embodiment, the guide rail 22 is disposed at an end of the hollow panel 10 in the width direction thereof (the left end in FIG. 2). In other words, the guide rail 22 is disposed at an end of the panel body 20 in the width direction of a cross section perpendicular to the extrusion direction. The guide rail 22 serves to guide, for example, a sliding door (not shown). A guide roller 23 disposed at the bottom end of the sliding door is rolled along the guide rail 22.

The panel body 20 constitutes a part of the hollow panel 10 on the right side of the first rib 14, which is disposed at the left end of the hollow panel 10. The panel body 20 includes a joint portion 24 and an intermediate portion 26. The joint portion 24 is disposed at the other end of the hollow panel 10 (the right end in FIG. 2) and constitutes a part of the hollow panel 10 outside the third rib 18 in the width direction (on the right side of the third rib 18 in FIG. 2). The joint portion 24 is formed in a box shape in cross section as shown in FIG. 2 to join the hollow panel 10 to another panel. The third rib 18, which constitutes a part of the joint portion 24, is formed perpendicularly to the plates 12 and extends over the length of the plates 12 in the extrusion direction. Similarly, the first rib 14 is formed perpendicularly to the plates 12 and extends over the length of the plates 12 in the extrusion direction. The first rib 14 is thicker than the second ribs 16 and the third rib 18.

The intermediate portion 26 constitutes a part of the hollow panel 10 between the joint portion 24 and the guide rail 22. The second ribs 16 are disposed between the plates 12 in the intermediate portion 26. The second ribs 16 are inclined with respect to the plates 12 in an alternate manner so as to form a zigzag pattern in the width direction of a cross section perpendicular to the extrusion direction. The second ribs 16 extend over the length of the plates 12 in the extrusion direction.

The intermediate portion 26 has a smaller wall thickness than the guide rail 22 and the joint portion 24, although the intermediate portion 26 has substantially the same wall thickness as the guide rail 22 in a predetermined region extending therefrom.

The guide rail 22 includes the first rib 14, protruding portions 28 protruding from the plates 12 to the outside of the first rib 14 in the width direction, and extended portions 30 extended from the outer ends of the protruding portions 28 to the inside of the plates 12. The extended portions 30 are separated from each other so as to define an opening 32 extending therebetween in the extrusion direction. A support 34 supporting the guide roller 23 is inserted into the guide rail 22 through the opening 32.

The guide rail 22 has a larger wall thickness than the part of the panel body 20 other than the predetermined region extending from the guide rail 22. This increases the rigidity of the guide rail 22 while inhibiting the increase in the total weight of the hollow panel 10.

Figure 3:
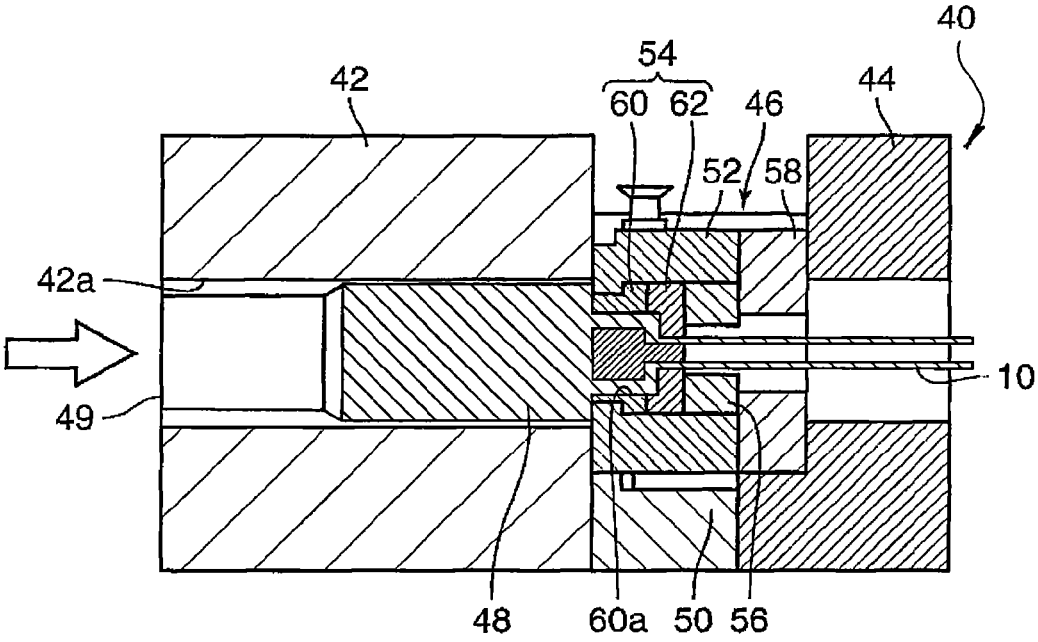
FIG. 3 is a schematic sectional view of the main part of an extruder.

A method for producing the hollow panel 10 is described below. The hollow panel 10 is produced using an extruder 40 shown in FIG. 3. This extruder 40 includes a container 42, a platen 44 separated from the container 42, and a die unit 46 disposed therebetween.

The container 42 has an inner hole 42*a* extending in the direction in which a billet 48 is extruded. A stem 49 coupled to a rod of a hydraulic cylinder (not shown) is slidably disposed in the inner hole 42*a*. The platen 44 is disposed on the extrusion side of the container 42 (the right side in FIG. 3) and is fixed in place.

The die unit 46 includes a die slide 50, a die ring 52, a die 54, a backer 56, and a bolster 58. The die slide 50 can be slid perpendicularly to the extrusion direction from a set position between the container 42 and the platen 44 to an escape position.

The die slide 50 holds the die ring 52. The die ring 52 and the bolster 58 are arranged in the horizontal direction of FIG. 3 and are held between the container 42 and the platen 44.

The die ring 52 is formed in a cylindrical shape and holds the die 54 and the backer 56, which are arranged in the extrusion direction in that order inside the die ring 52.

Figure 4:
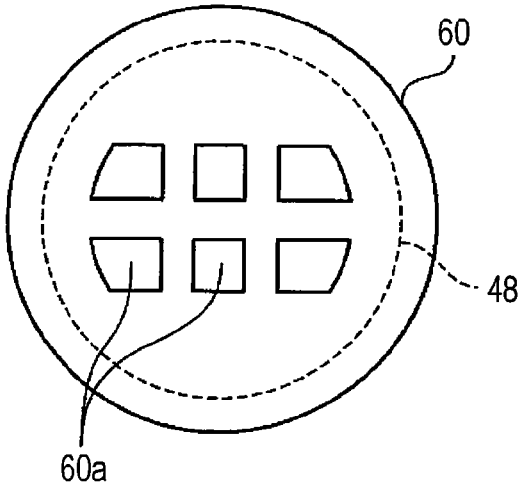
FIG. 4 is a schematic front view of an injection portion of a die of the extruder.
Figure 5:
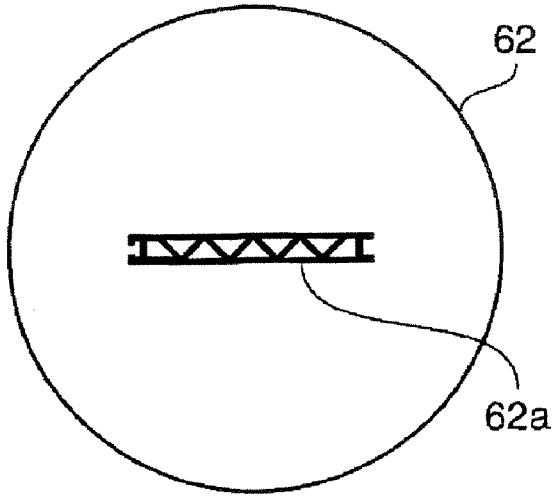
FIG. 5 is a schematic front view of an extrusion portion of the die of the extruder.

Referring to FIGS. 4 and 5, the die 54 includes an injection portion 60 and an extrusion portion 62 disposed on the extrusion side of the injection portion 60. The billet 48 is extruded from the container 42 and is injected into the injection portion 60. The injection portion 60 has entry ports 60*a* penetrating therethrough in the extrusion direction. The billet 48 extruded from the container 42 is injected and split into the entry ports 60*a*. FIG. 4 is a schematic view of the injection portion 60 from the container 42 side.

The extrusion portion 62 has a die hole 62*a* for merging extrudates of the billet 48 passing through the entry ports 60*a* and extruding them in the shape of the hollow panel 10. As shown in FIG. 5, the die hole 62*a* has the shape corresponding to the cross-sectional shape of the hollow panel 10 on the extrusion side.

The stem 49 is actuated with the hydraulic cylinder to extrude the billet 48 from the container 42. The billet 48 is then injected and split into the entry ports 60*a* of the injection portion 60 of the die 54. The extrudates passing through the entry ports 60*a* of the injection portion 60 are merged and injected into the die hole 62*a* of the extrusion portion 62 to extrude the hollow panel 10, which includes the panel body 20 and the guide rail 22 as one piece.

According to the first embodiment, as described above, the panel body 20 and the guide rail 22 are integrally formed by extrusion to produce the hollow panel 10. The position where the guide rail 22 is formed therefore depends on the size and shape of the die 54 of the extruder 40. This ensures stable positional and dimensional accuracy of the guide rail 22. In addition, the hollow panel 10 can be produced by a simpler process than panels of the known art which have a guide rail attached later by, for example, welding.

The guide rail 22 is formed as an example of the open segment in the first embodiment, although the open segment is not limited to guide rails.

Figure 6:
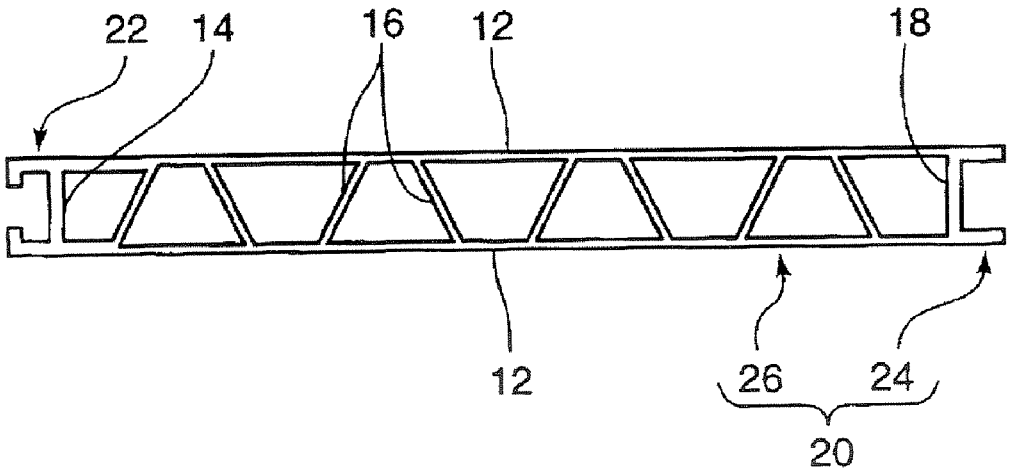
FIG. 6 is a side view of a hollow panel according to a modification of the first embodiment of the present invention in the extrusion direction.
Figure 7:
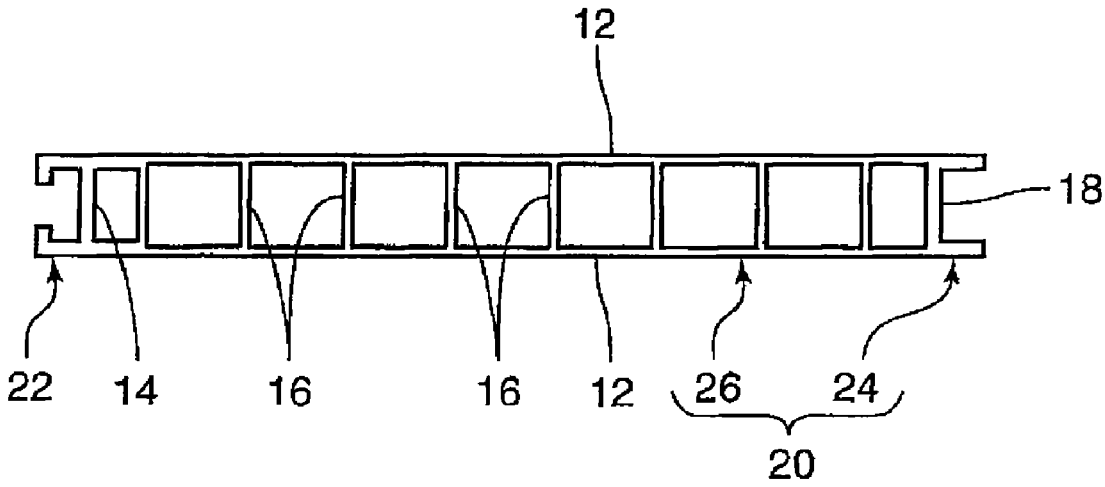
FIG. 7 is a side view of a hollow panel according to another modification of the first embodiment of the present invention in the extrusion direction.

The second ribs 16 are arranged continuously in the width direction such that they form a triangular pattern inside the closed segment when viewed in the extrusion direction, although the arrangement of the second ribs 16 is not limited to the example described above. Referring to FIG. 6, for example, the second ribs 16 may be separated such that they form a trapezoidal pattern inside the closed segment when viewed in the extrusion direction. Referring to FIG. 7, alternatively, the second ribs 16 may be disposed perpendicularly to the plates 12 such that they form a rectangular pattern inside the closed segment.

Second Embodiment

In a second embodiment of the present invention, the hollow panel 10 is formed in the same shape as the floor panel shown in FIGS. 1 and 2. The second embodiment is different from the first embodiment in that the panel body 20 and the guide rail 22 are formed of different materials.

In the second embodiment, specifically, the guide rail 22 and the panel body 20 are formed of different aluminum alloys. The aluminum alloy (second material) used for the guide rail 22 has a higher strength than the aluminum alloy (first material) used for the panel body 20. Examples of the second material used include JIS (Japanese Industrial Standards) 7000 series aluminum alloys, such as alloy numbers 7075 and 7N01. Examples of the first material used include JIS 6000 series aluminum alloys, such as alloy number 6N01.

Figure 8:
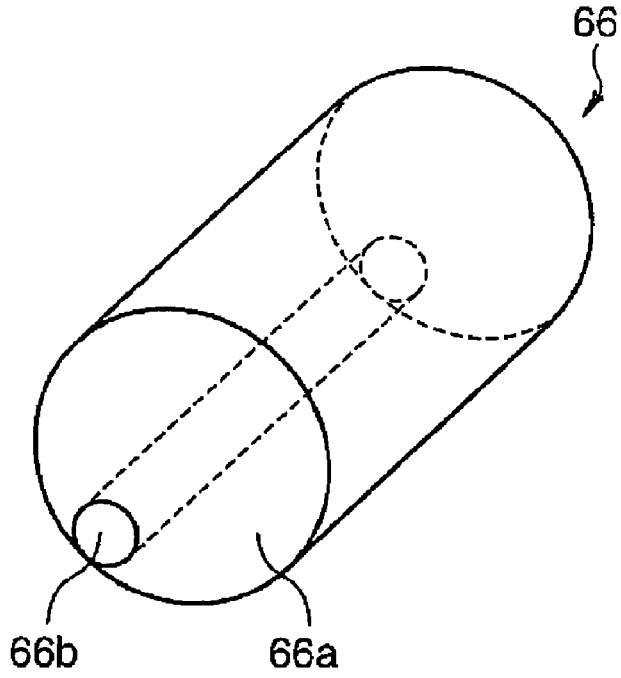
FIG. 8 is a perspective view of a composite material billet.

The hollow panel 10 according to the second embodiment is formed by preparing a composite material billet 66 with two aluminum alloys in advance, as shown in FIG. 8, and extruding the composite material billet 66 using an extruder. The composite material billet 66 includes a main portion 66*a* formed of the first material for the panel body 20 and a cylindrical auxiliary portion 66*b* formed of the second material for the guide rail 22. The composite material billet 66 is formed in a cylindrical shape with the auxiliary portion 66*b* incorporated along the circumferential surface of the main portion 66*a*.

Figure 9:
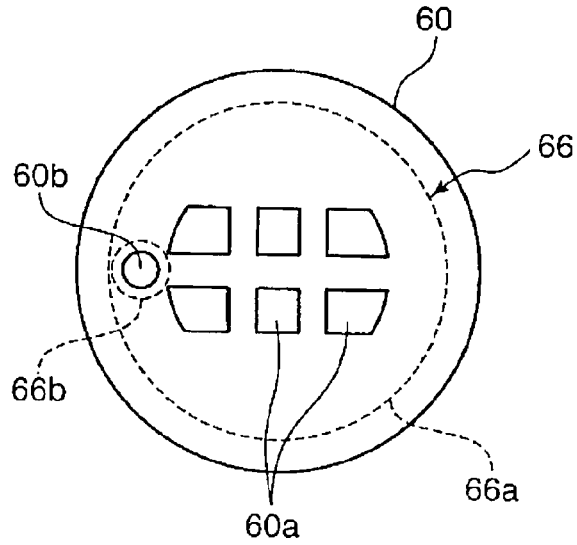
FIG. 9 is a schematic front view of an injection portion used for extrusion of a hollow panel according to a second embodiment of the present invention.

Referring to FIG. 9, an entry port 60*b* for the second material may be formed in the injection portion 60 of the die 54 to produce the hollow panel 10 using the composite material billet 66. The entry port 60*b* for the second material, when viewed in the extrusion direction, is positioned on the same side as the part of the die hole 62*a* corresponding to the guide rail 22. The entry port 60*b* is defined so that an extrudate passing therethrough is injected into the part of the die hole 62*a* corresponding to the guide rail 22.

The ratio of the flow rates of the extrudates passing through the entry ports 60*a* for the first material and the extrudate passing through the entry port 60*b* for the second material may be adjusted so as to agree with the volume distribution ratio of the panel body 20 and the guide rail 22 (see Japanese Patent No. 3645453). The hollow panel 10 can then be formed such that the welded portions of the first and second materials substantially agree with the boundary between the panel body 20 and the guide rail 22. The volume distribution ratio refers to the ratio of the volumes of the panel body 20 and the guide rail 22 per unit length of the hollow panel 10.

According to the second embodiment, as described above, the guide rail 22 is formed so as to have a higher strength than the panel body 20. The strength of the guide rail 22 can thus be increased while inhibiting the increase in the total weight of the hollow panel 10. Hence, the hollow panel 10 can more readily achieve a desired strength.

In the second embodiment, additionally, the composite material billet 66 is prepared in advance and is extruded using an extruder to form the hollow panel 10 in one extrusion operation. The hollow panel 10 can thus be produced by a simpler process.

The guide rail 22 has a larger wall thickness than the panel body 20 to ensure the required strength in the first embodiment while different materials are used for the guide rail 22 to ensure the required strength in the second embodiment. In the second embodiment, the guide rail 22 may have substantially the same wall thickness as the panel body 20 in some panel applications. The rest of the structure, the operation, and the advantages is the same as in the first embodiment.

Third Embodiment

Figure 10:
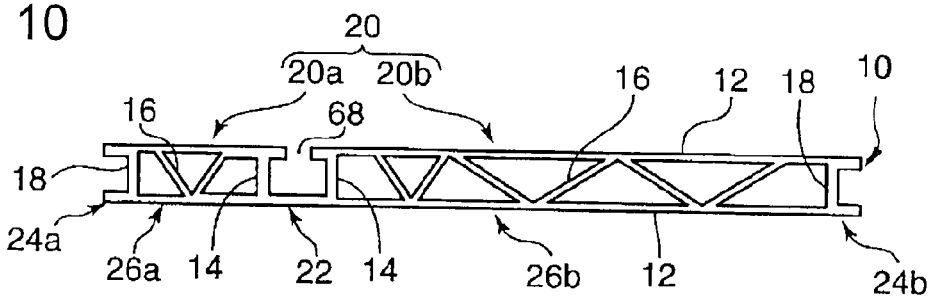
FIG. 10 is a side view of a hollow panel according to a third embodiment of the present invention in the extrusion direction.

In a third embodiment of the present invention, the hollow panel 10 is configured as a floor panel for automobiles. The third embodiment is different from the first embodiment in that the guide rail 22 is formed in the intermediate portion of the hollow panel 10 in the width direction (perpendicular to the extrusion direction), as shown in FIG. 10. For example, the guide rail 22 is used to guide a seat (not shown) when the seat is slid forward and backward.

In the third embodiment, the guide rail 22 separates the panel body 20 into two segments in the width direction. An opening 68 extending in the extrusion direction is defined at a position on the upper plate 12 where the guide rail 22 is to be formed, and the first rib 14 is disposed on each of the two sides of the opening 68. The guide rail 22 is defined by the two adjacent first ribs 14, portions of the upper plate 12 extending between the two first ribs 14, and a portion of the lower plate 12 opposite the portions of the upper plate 12. The portion of the lower plate 12 opposite the opening 68 has a larger thickness than the rest of the lower plate 12 to increase the strength of the guide rail 22.

The panel body 20, when viewed in the extrusion direction, includes a first body segment 20*a* disposed on the left side of the guide rail 22 and a second body segment 20*b* disposed on the right side of the guide rail 22. The first body segment 20*a* includes a joint portion 24*a* and an intermediate portion 26*a*, and the second body segment 20*b* includes a joint portion 24*b* and an intermediate portion 26*b*. The joint portions 24*a* and 24*b* are disposed at the ends of the hollow panel 10 in the width direction to join the hollow panel 10 to, for example, other panels. The intermediate portions 26*a* and 26*b* are disposed between the guide rail 22 and the joint portion 24*a* and between the guide rail 22 and the joint portion 24*b*, respectively. The intermediate portions 26*a* and 26*b* include the second ribs 16, and the joint portions 24*a* and 24*b* each include the third rib 18.

According to the third embodiment, the panel body 20 and the guide rail 22 are integrally formed by extrusion, as in the previous embodiments. This ensures stable positional and dimensional accuracy of the guide rail 22. In addition, the hollow panel 10 can be produced by a simpler process.

The single guide rail 22 is defined in the intermediate portion of the panel body 20 in the third embodiment, although the number of guide rails is not limited. For example, two guide rails may be defined to separate the panel body 20 into three segments in the width direction. In addition, the panel body 20 and the guide rail 22 may be formed of different materials as in the second embodiment. The rest of the structure, the operation, and the advantages is the same as in the first embodiment.

Fourth Embodiment

Figure 11:
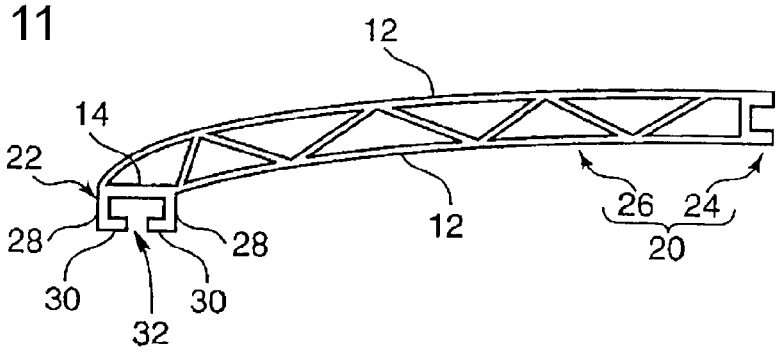
FIG. 11 is a side view of a hollow panel according to a fourth embodiment of the present invention in the extrusion direction.

In a fourth embodiment of the present invention, the hollow panel 10 is configured as a roof panel for automobiles, as shown in FIG. 11. In this embodiment, the pair of plates 12 are curved with the ribs 14, 16, and 18 disposed therebetween. The guide rail 22 is disposed at an end of the panel body 20 in the width direction with the first rib 14 positioned horizontally. The protruding portions 28 extend downward from the first rib 14, and the extended portions 30 are extended horizontally from the bottom ends of the protruding portions 28. The protruding portions 28 and the extended portions 30 thus define the opening 32, which faces downward. A guide roller disposed at the top end of a sliding door (not shown) is rolled along the guide rail 22.

The hollow panel 10 is formed as a one-piece roof panel using a single material in this embodiment, although the panel body 20 and the guide rail 22 may be formed of different materials as in the second embodiment. The rest of the structure, the operation, and the advantages is the same as in the first embodiment.

Fifth Embodiment

Figure 12:
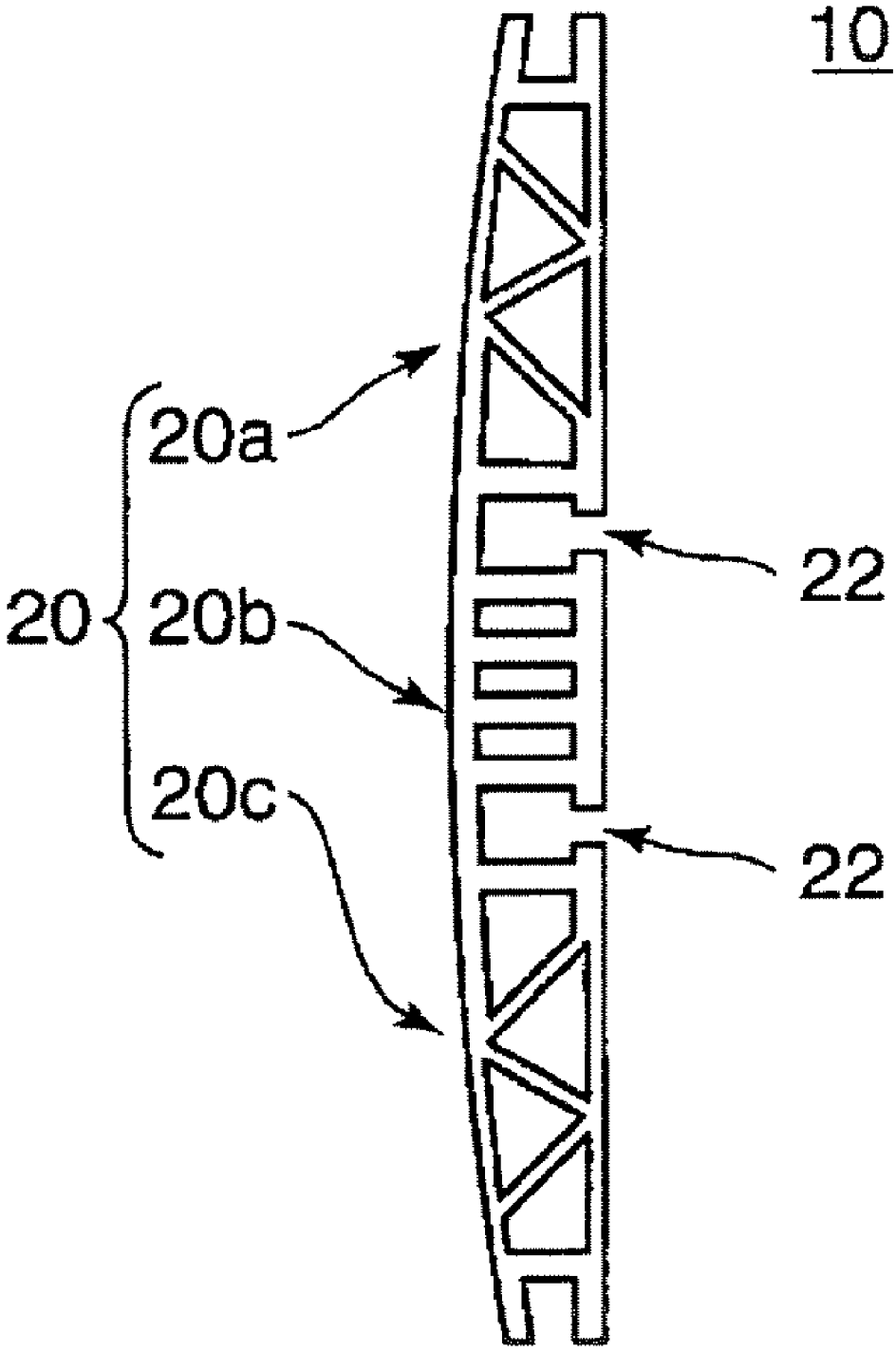
FIG. 12 is a side view of a hollow panel according to a fifth embodiment of the present invention in the extrusion direction.

In a fifth embodiment of the present invention, the hollow panel 10 is configured as a door panel for automobiles, as shown in FIG. 12. The hollow panel 10 has upper and lower guide rails 22 which separate the panel body 20 into three segments, that is, a first body segment 20*a*, a second body segment 20*b*, and a third body segment 20*c*.

One of the plates 12 is substantially flat while the other is curved. The hollow panel 10 is therefore thicker in the center of the height thereof, rather than being uniform in thickness.

The second body segment 20*b* disposed between the two guide rails 22 has a larger wall thickness than the first body segment 20*a* disposed on the top side of the guide rails 22 and the third body segment 20*c* disposed on the bottom side of the guide rails 22 to increase the strength of the hollow panel 10 for use as a door panel.

The hollow panel 10 is formed as a one-piece door panel using a single material in this embodiment, although the panel body 20 and the guide rails 22 may be formed of different materials as in the second embodiment. The rest of the structure, the operation, and the advantages is the same as in the first embodiment.

What is claimed is:

1. An extruded hollow aluminum alloy panel for automobiles, the panel comprising:

two plates;

a first rib joining the plates, the first rib extending perpendicular to the plates and provided adjacent one end of the plates;

a plurality of second ribs joining the plates, the second ribs provided at a side of the first rib which is opposite the one end of the plates, whereby the plates each have a portion that extends from said first rib to one of said second ribs which is closest to said first rib, the panel including an open segment and a closed segment that are integrally formed by extrusion so as to extend in an extrusion direction, the open segment being configured as a guide rail, the closed segment having a plurality of closed spaces defined between the plates by the first and second ribs in a cross section perpendicular to the extrusion direction, the open segment having an open space in the cross section, wherein the open segment includes the first rib, protruding portions protruding from the two plates to the outside of the rib in the width direction, and extended portions extended from the outer ends of the protruding portions to the inside of the plates, the extended portions defining an opening extending in the extrusion direction to form the open space, and wherein the open segment and said portion of both of said plates that extends from said first rib to said one of said second ribs which is closest to said first rib are constructed to have a higher strength than the strength of a remainder of the closed segment.

2. The extruded hollow aluminum alloy panel according to claim 1, wherein the rib, protruding portions and extended portions of the open segment all have a greater thickness than the thickness of the plates and ribs of the closed segment, whereby the open segment has a higher strength than that of the closed segment.

3. The extruded hollow aluminum alloy panel according to claim 1, wherein the rib, protruding portions and extended portions of the open segment are all formed of a first extruded aluminum alloy, and the plates and ribs of the closed segment are all formed of a second extruded aluminum alloy, wherein the first extruded aluminum alloy is different from, and has a higher strength than the strength of, the second extruded aluminum alloy, whereby the open segment has a higher strength than that of the closed segment.

4. A method for producing the extruded hollow aluminum alloy panel according to claim 1, comprising the step of integrally forming the open segment and the closed segment by extruding the materials therefor together.

5. A method for producing the extruded hollow aluminum alloy panel according to claim 3, comprising the steps of:

preparing a composite material billet with the aluminum alloy for the open segment and the aluminum alloy for the closed segment; and extruding the composite material billet to form the extruded hollow aluminum alloy panel.

* * * * *